US007398040B2

(12) United States Patent
Yoshida

(10) Patent No.: US 7,398,040 B2
(45) Date of Patent: Jul. 8, 2008

(54) DEVELOPING APPARATUS, CARTRIDGE AND IMAGE FORMING APPARATUS

(75) Inventor: Masahiro Yoshida, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 207 days.

(21) Appl. No.: 11/002,948

(22) Filed: Dec. 3, 2004

(65) Prior Publication Data

US 2005/0180784 A1 Aug. 18, 2005

(30) Foreign Application Priority Data

Dec. 11, 2003 (JP) ..... 2003-413500

(51) Int. Cl.
*G03G 15/08* (2006.01)
*G03G 15/06* (2006.01)
*G03G 15/30* (2006.01)

(52) U.S. Cl. ..... 399/284; 399/222; 399/149

(58) Field of Classification Search ..... 399/284, 399/222, 149
See application file for complete search history.

(56) References Cited

U.S. PATENT DOCUMENTS

| | | | | |
|---|---|---|---|---|
| 6,128,456 | A | 10/2000 | Chigono et al. | 399/176 |
| 6,128,462 | A | 10/2000 | Kato et al. | 399/350 |
| 6,169,869 | B1 | 1/2001 | Inami et al. | 399/159 |
| 6,175,703 | B1 | 1/2001 | Nakazono et al. | 399/111 |
| 6,337,964 | B2 | 1/2002 | Inami et al. | 399/254 |
| 6,539,190 | B2 | 3/2003 | Oba et al. | 399/174 |
| 6,879,793 | B2 * | 4/2005 | Chiba et al. | 399/149 |
| 2002/0159782 | A1 * | 10/2002 | Tsuruya et al. | 399/50 |
| 2003/0215731 | A1 * | 11/2003 | Saiki et al. | 430/110.3 |
| 2004/0013446 | A1 | 1/2004 | Morioka et al. | 399/111 |

FOREIGN PATENT DOCUMENTS

| | | |
|---|---|---|
| JP | 8-211728 | 8/1996 |
| JP | 10-307455 | 11/1998 |
| JP | 2002-229329 | 8/2002 |

* cited by examiner

*Primary Examiner*—Vincent Q. Nguyen
*Assistant Examiner*—Amy He
(74) *Attorney, Agent, or Firm*—Fitzpatrick, Cella, Harper & Scinto

(57) ABSTRACT

A developing apparatus includes a developer carrying member for carrying a developer thereon and developing an electrostatic image formed on an image bearing member with a developer, a developer layer thickness regulating member provided in contact with the developer carrying member for regulating the thickness of the layer of the developer carried on the developer carrying member, and an electrically conductive particle provided in the portion of contact between the developer carrying member and the developer layer thickness regulating member, in a state in which the developer does not exist between the developer carrying member and the developer layer thickness regulating member.

8 Claims, 11 Drawing Sheets

PRIOR ART

PRIOR ART

PRIOR ART

PRIOR ART

DEVELOPING APPARATUS, CARTRIDGE AND IMAGE FORMING APPARATUS

BACKGROUND OF THE INVENTION

1. Field of the Invention

The invention relates to an image forming apparatus, a cartridge and a developing apparatus for application to an electrophotographic apparatus such as a laser beam printer or a copying machine and an electrostatic recording apparatus or the like.

2. Description of the Related Art

FIG. 9 of the accompanying drawings shows an image forming apparatus as an example using a conventional developing apparatus. In FIG. 9, the reference numeral 101 designates the main body of the image forming apparatus, which is a printer engine. The reference numeral 111 denotes a cylindrical photosensitive drum, which is an image bearing member, and it is rotated in one direction about the axis thereof. A charging roller 103 is constituted by a mandrel 103*a* and a rubber material 103*b* disposed on the mandrel 103*a*, and uniformly charges the surface of the photosensitive drum 111.

After the surface of the photosensitive drum 111 has been uniformly charged, a laser beam 55 corresponding to the time-series electrical digital image signal of image information is outputted by an exposing apparatus 102, and is turned back toward the surface of the photosensitive drum by a mirror 56, whereby a latent image is formed on the drum 111.

A developing apparatus 208, as shown in FIG. 11 of the accompanying drawings, is provided with runners 209 on the opposite end portions of a developing sleeve 105, which is a developer carrying member, and the runners 209 contact the photosensitive drum 111 to thereby keep a predetermined gap between the developing sleeve 105 and the photosensitive drum 111. The developing sleeve 105 receives a drive force transmitted from a photosensitive drum gear 211 to a developing sleeve gear 212 to thereby effect rotation, and a toner 109 applied onto the developing sleeve 105 flies onto the photosensitive drum 111 in a developing area as soon as a bias is applied to the developing sleeve 105 through a sliding contact (not shown) and effects reversal developing to thereby visualize the latent image formed on the photosensitive drum 111.

The design of the apparatus is such that a developing bias comprising a DC bias and an AC bias superimposed one upon the other is provided between the photosensitive drum 111 and the developing sleeve 105 by an engine controlling portion (not shown) provided with a power source for driving the image forming apparatus, and a high voltage circuit for supplying a bias for forming an image.

The image on the photosensitive drum 111 visualized by the toner 109 is transferred to a transfer material 114 by a transferring apparatus 110. The transfer material 114 is contained in a sheet supplying cassette 117 and is fed by a sheet feeding roller 116, and is synchronized with the image on the photosensitive drum 111 by registration rollers (not shown) and is fed to the transferring apparatus 110. The visible image by the toner 109 transferred to the transfer material 114 by the transferring apparatus 110 is conveyed to a fixing apparatus 115 with the transfer material 114, and is fixed on the transfer material 114 by heat or pressure and becomes a recorded image.

On the other hand, the residual toner 109 untransferred on the photosensitive drum 111 after the transfer is removed by a cleaning blade 113 in a cleaning apparatus 112. The surface of the photosensitive drum 111 from which the toner 109 has been removed is again charged by the charging roller 103 and repeats the above-described process.

As the conventional developing apparatus, a developing apparatus 208 using a magnetic one-component toner, which is a developer, is shown in detail in FIG. 10 of the accompanying drawings. In FIG. 10, the developing sleeve 105 as a developer carrying member is a non-magnetic developing sleeve formed by a pipe of aluminum or stainless steel, and a magnet roll 106 alternately formed with a plurality of magnetic poles N and S is disposed therein immovably relative to the developing sleeve 105.

The surface of the developing sleeve 105 is worked to an appropriate surface roughness so as to be capable of carrying a desired amount of toner. At a location on the developing sleeve 105, as a developer layer thickness regulating member (hereinafter referred to as the developing blade), a developing blade 107*a* of e.g. urethane rubber or silicone rubber fixed to a supporting metal plate 107*b* is made to abut against the sleeve with predetermined pressure.

The toner 109 attracted to the developing sleeve by a magnetic force is regulated to a suitable amount by frictional charging by being carried on the developing sleeve, and by the developing blade 107*a* portion, and thereafter is given appropriate charges (triboelectricities) by frictional charging by being rubbed between the developing sleeve and the developing blade, and is carried to a developing area. The toner 109 carried to the developing area as described above, when a bias is applied to the developing sleeve 105, flies from the developing sleeve 105 and develops the latent image on the photosensitive drum.

In such a developing apparatus as described above, generally with respect to quality confirmation, such as appearance inspection in the assembling step, and the prevention of toner leakage during distribution, it is often the case that as shown in FIG. 12 of the accompanying drawings, the toner is contained in a toner container 104 by a toner seal 50 and the toner does not adhere onto the developing sleeve until the developing apparatus is delivered to the hand of a user. The user, when the user uses a new developing apparatus for the first time, can pull the toner seal 50, for example, toward this side in FIG. 12, to thereby bring about the state of the developing apparatus as shown in FIG. 10, and can bring the developing apparatus 208 into a usable state in which as indicated by the arrow C in FIG. 10, the toner 109 flows from within the toner container 104 toward the developing sleeve 105, and is attracted to the developing sleeve 105.

However, if the user rotates the developing sleeve by mistake with the toner seal 50 remaining provided, when the developing blade is formed of an elastic material such as urethane rubber, there are the problems that the developing blade is turned up in the direction of rotation of the developing sleeve due to the frictional resistance between the developing blade and the developing sleeve, and it becomes impossible to effect uniform and good toner coating, and the problems that deep frictional contact flaws are formed on the surfaces of the developing blade and the developing sleeve, and if thereafter the developing sleeve is coated with the toner to thereby form an image, vertical streaks attributable to the frictional contact flaws will occur on a halftone image or a solid black image (a full-page black image).

Also, for the convenience of the step of assembling or inspecting the developing apparatus in a factory, it is necessary to rotate the developing sleeve in a state in which the toner is absent on the developing sleeve, and there has been required a technique which does not cause frictional contact flaws on the developing blade and the developing sleeve or the turning-up of the developing blade even when the toner is absent on the developing sleeve.

Regarding this problem, it is conceivable to use a lubricant in the frictional contact portion between the developing blade and the developing sleeve. So, it is conceivable to use a slight amount of toner as the lubricant, but depending on the custody situation in a state in which temperature/humidity is very high such as the export by a ship or the transportation in summertime, the toner may sometimes deteriorate and be fusion-bonded on the developing blade and the developing sleeve and therefore, it is not preferable to use the toner as the lubricant.

So, in order to solve this problem, there is a method of using silicone resin particles or the like as the lubricant, and apply them to that surface of the developing blade which abuts against the developing sleeve. As a method of applying the lubricant, there is a method of applying to the developing blade a solution having powder particles dispersed in volatile liquid (the powder particles should have solvent resistance to the volatile liquid), and in this method, powder particles left after the liquid has been completely volatilized are used as the lubricant (this method will hereinafter be referred to as the liquid applying method). It is for uniformly applying the lubricant that the lubricant is once dispersed in the liquid.

Also, Japanese Patent Application Laid-open No. H8-211728 proposes a method of powder-applying a lubricant directly to the developing sleeve. According to this method, improvement can be made over a halftone vertical streak which may occur in a method of applying liquid to the developing blade.

Also, as lubricating particles, use is made of organic materials such as silicone resin, poly-ethylene tetrafluoride, polyethylene trifluoride and polyvinylidene fluoride, or an inorganic material such as molybdenum sulfide. Among these, silicone resin is particularly suitable with respect to heat resistance and humidity resistance.

On the other hand, as a technique which does not cause maintenance work, such as the user filling the developing apparatus with the toner when the toner in the developing apparatus has been exhausted, a technique of making the photosensitive drum, the cleaning apparatus, the charging apparatus, the developing apparatus, etc. integral with each other to thereby provide a process cartridge is popular. As shown in FIG. 13 of the accompanying drawings, the photosensitive drum 111, the charging roller 103, the cleaning apparatus 112 and the developing apparatus 208 are united together by packaging 12 and made into an integral type cartridge 206. The process cartridge has the easy maintenance property that when the toner in the developing apparatus has been used up, the process cartridge is simply exchanged relative to a printer main body, whereby a desired image can be easily obtained again, and is designed such that as soon as the toner in the developing apparatus is used up, the other devices end their lives substantially at the same time, and is a technique which enables a stable quality of image to be obtained until the toner is used up.

However, in a case where use is made of the above-described lubricant according to the conventional art, when the lubricant applied to the developing apparatus adheres to the photosensitive member or the charging roller which is charging means due to vibration or the like in the assembling step or by the transportation of the process cartridge, a black spot of the pitch of the charging roller has sometimes occurred on an image in a portion to which the lubricant has adhered because the lubricant is insulative.

Also, if the lubricant is insulative, a faulty image has sometimes occurred due to the charge-up of the developer at the beginning of the use of the developing apparatus.

SUMMARY OF THE INVENTION

It is an object of the present invention to provide a developing apparatus, a cartridge and an image forming apparatus in which the frictional resistance between a developer carrying member and a developer layer thickness regulating member is reduced.

It is another object of the present invention to provide a developing apparatus, a cartridge and an image forming apparatus in which the turning-up of a developer layer thickness regulating member is prevented.

It is another object of the present invention to provide a developing apparatus, a cartridge and an image forming apparatus in which a flaw is prevented from occurring to a developer carrying member or a developer layer thickness regulating member.

It is another object of the present invention to provide a developing apparatus, a cartridge and an image forming apparatus in which a streak is prevented from occurring on an image.

It is another object of the present invention to provide a developing apparatus, a cartridge and an image forming apparatus in which a faulty image due to an insulative lubricant adhering to an image bearing member or charging means is prevented.

It is another object of the present invention to provide a developing apparatus, a cartridge and an image forming apparatus in which the charge-up of a developer is prevented at the beginning of the use of the developing apparatus.

Further objects and features of the present invention will become more apparent from the following detailed description when read with reference to the accompanying drawings.

DESCRIPTION OF THE PREFERRED EMBODIMENTS

Some embodiments of the developing apparatus, the cartridge and the image forming apparatus of the present invention will hereinafter be described.

First Embodiment

A first embodiment of the present invention will hereinafter be described with reference to the accompanying drawings.

Figure 1:
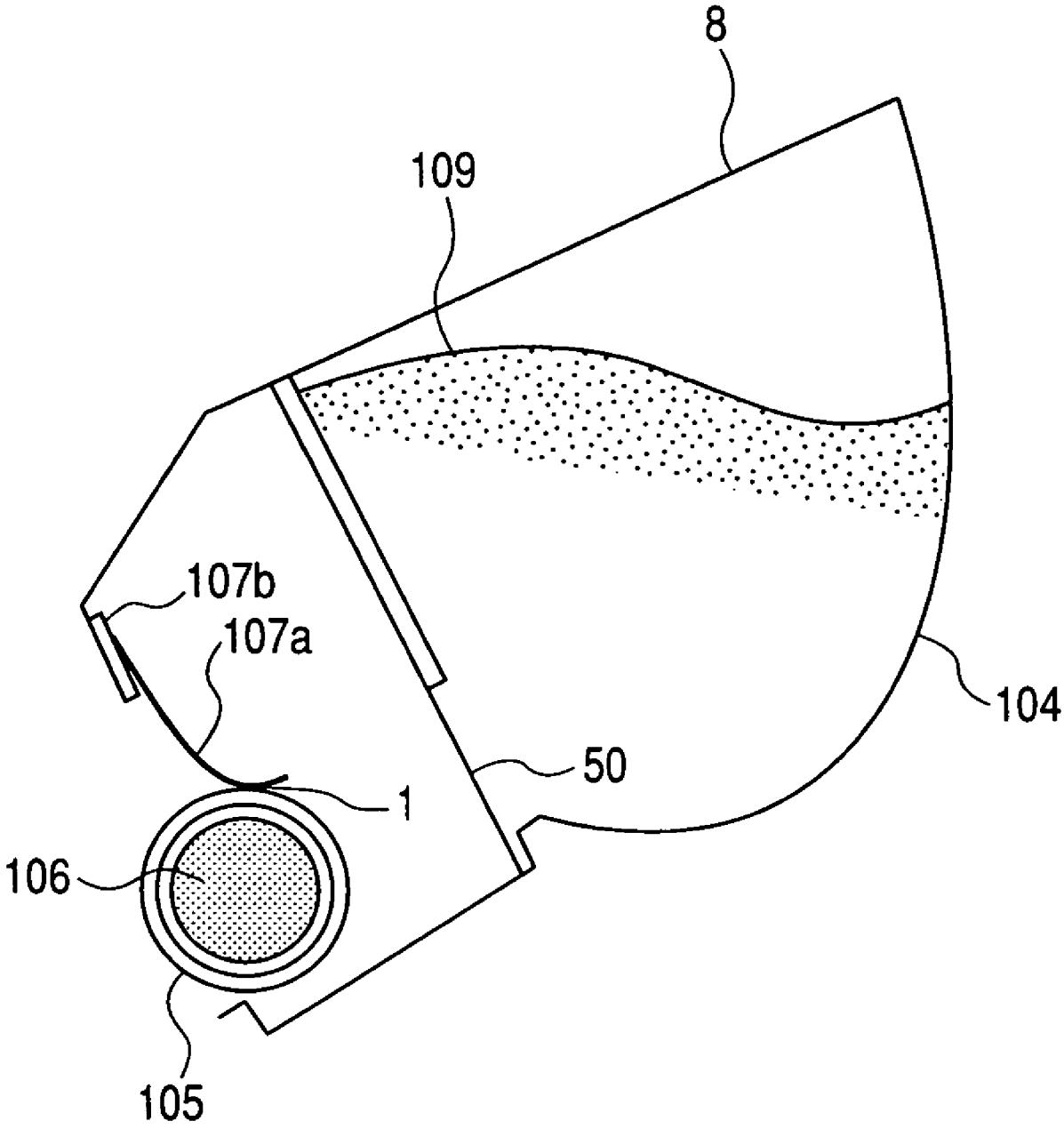
FIG. 1 is a schematic cross-sectional view of a developing apparatus according to a first embodiment of the present invention.

FIG. 1 shows the feature of a developing apparatus 8 according to the first embodiment of the present invention best.

Figure 2:
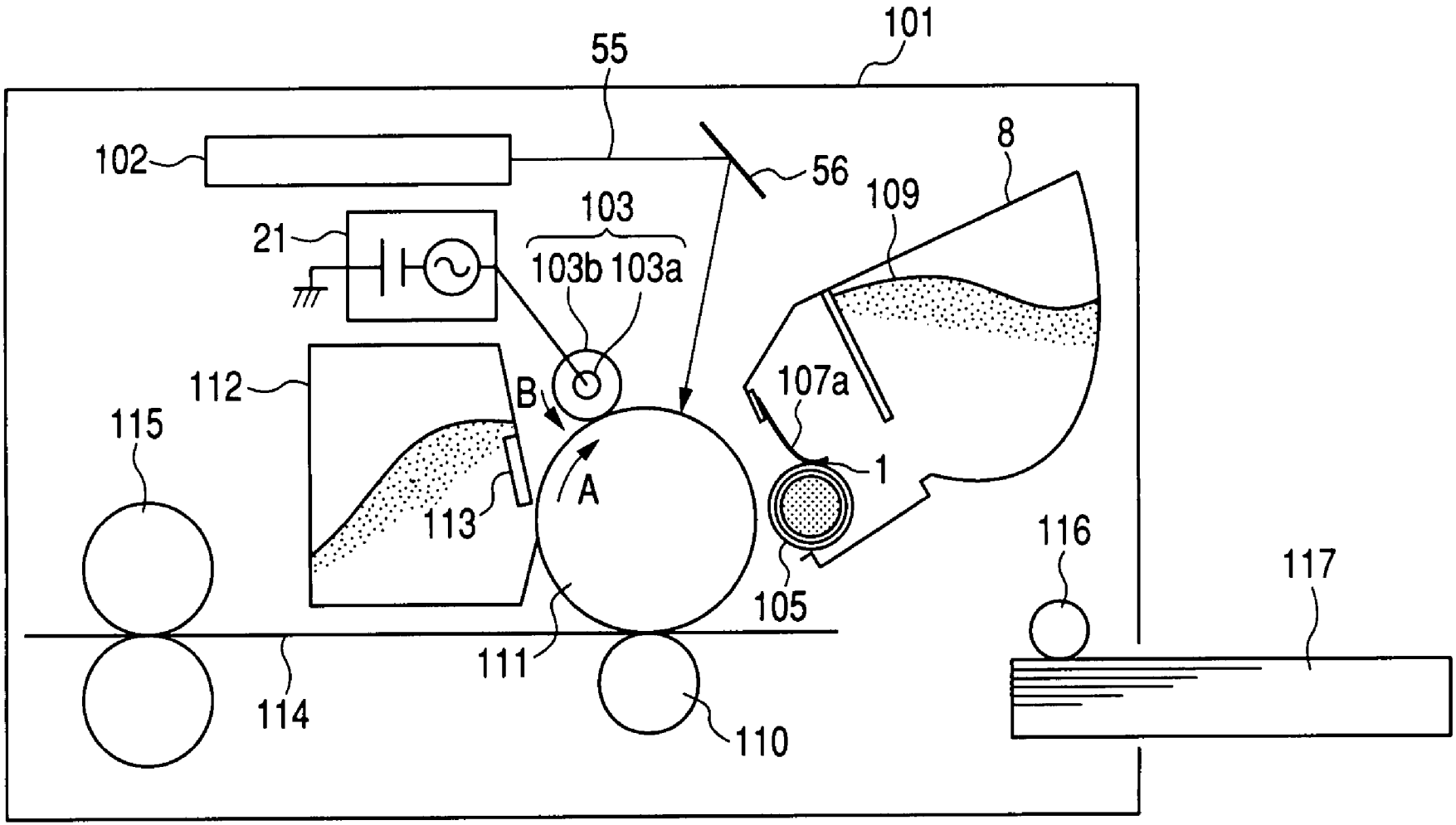
FIG. 2 is a schematic cross-sectional view of an image forming apparatus according to the first embodiment of the present invention.
Figure 12:
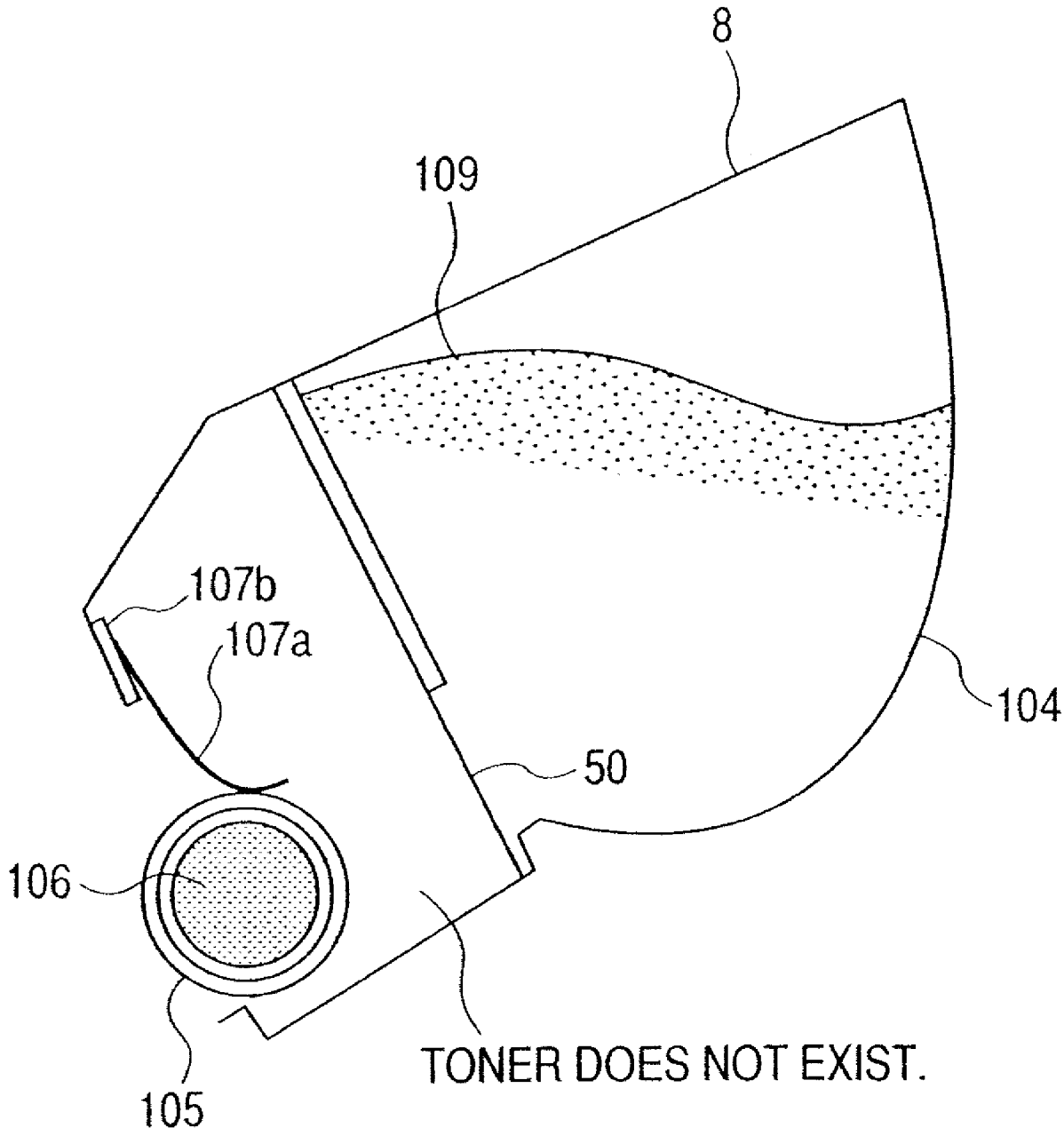
FIG. 12 is a schematic cross-sectional view of the developing apparatus according to the conventional art.
Figure 13:
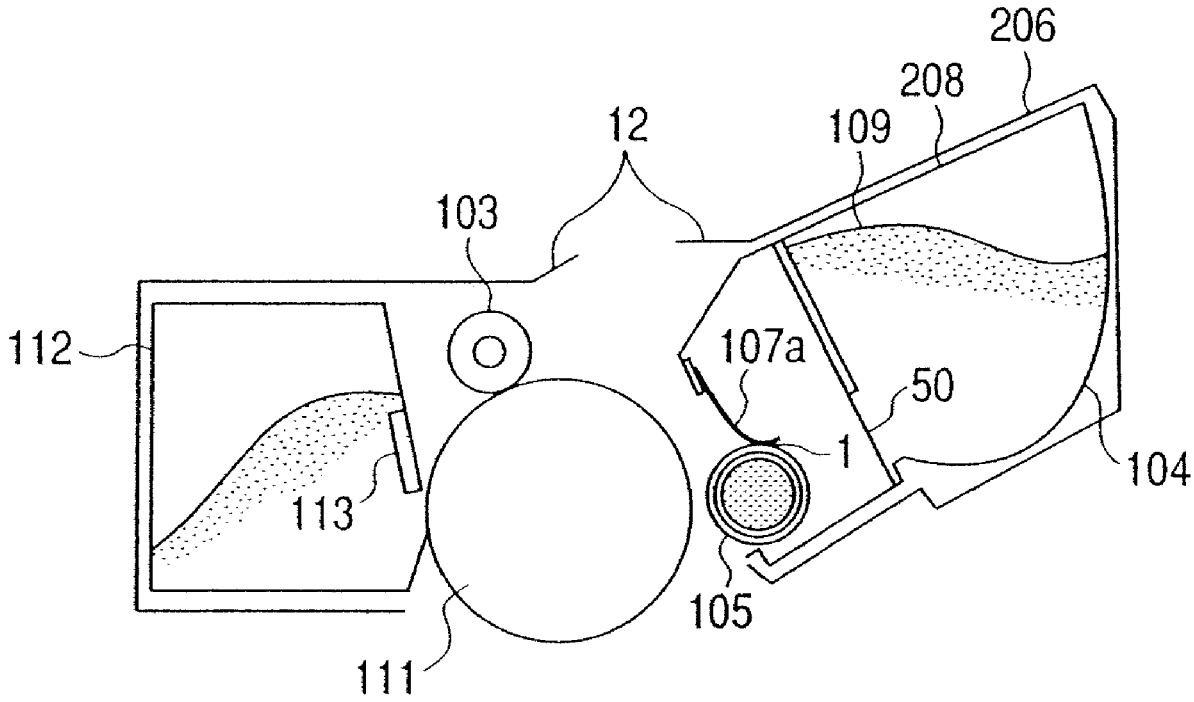
FIG. 13 is a schematic cross-sectional view of a process cartridge according to the conventional art.

FIG. 2 shows a state in which the developing apparatus 8 according to the first embodiment of the present invention is installed in the main body of an image forming apparatus after the toner seal 50 of the developing apparatus has been removed. The same constituents as those described in the conventional art are given the same reference characters. When the developing apparatus is in a new state, a removable toner seal 50 is provided, as shown in FIG. 12, so that a toner as a developer may not adhere to a developing sleeve 105 which is a developer carrying member and a developing blade 107*a* which is a developer regulating member. When a user begins to use the developing apparatus, the user removes the toner seal 50, whereby it becomes possible for the toner to be carried to the developing sleeve 105 and the developing blade 107*a*. After the toner seal 50 has been removed, the developing apparatus is mounted on the main body of the image forming apparatus.

The charging method in the present embodiment is a so-called contact charging method, and in FIG. 2, a charging roller 103, which is charging means (charging member), is brought into contact with a photosensitive drum 111, which is an image bearing member, with predetermined pressure. When the photosensitive drum 111 is rotated in the direction indicated by the arrow A in FIG. 2 by receiving a drive force from a driving system (not shown) in the main body of a printer which is the image forming apparatus, the charging roller 103 follows the rotation of the photosensitive drum 111 and is rotated in the direction indicated by the arrow B in FIG. 2.

The mandrel 103*a* of the charging roller is designed to receive the supply of a bias voltage by a voltage source 21 provided in the printer main body, and by the bias voltage being applied, the photosensitive drum is charged to thereby obtain a predetermined surface potential.

The bias voltage may be a DC bias alone, or an AC bias superimposed upon a DC bias. In the present embodiment, the bias voltage is a sine wave of an AC bias Vpp=1800V superimposed upon a DC bias −620V. Thereby, in the present embodiment, the surface potential Vd on the photosensitive drum has become about −600V. Also, the potential of the exposed portion of the photosensitive drum by an exposing apparatus 102, such as a laser scanner as electrostatic image forming means for forming an electrostatic image on the photosensitive drum, has been Vl=−150V.

An example of the developing apparatus according to the present invention will be shown below. The developing sleeve 105, which is a developer carrying member, is a non-magnetic aluminum sleeve of φ16 (mm), and has its surface coated with a resin layer containing electrically conductive particles in order to effect the carrying of the toner which is the developer and the imparting of triboelectricity, and the surface roughness of the surface thereof is usually an average of 0.4 μm-3.5 μm in terms of Ra of JIS standard, and in the present embodiment, use is made of surface roughness having an average Ra of 1.7 μm.

In the developing sleeve there is disposed a magnet roll 106, which is a four-pole magnet. As the developing blade 107*a* which is a developer layer thickness regulating member, urethane rubber of the order of JISA hardness 67° is made to abut against the developing sleeve with a nip width relative to the developing sleeve so that the abutting force thereof may be 20-40 gf/cm (abutting load per 1 cm with respect to the longitudinal direction of the sleeve). In the present embodiment, the nip width is about 1 mm.

As the toner 109, use is made of a negatively chargeable magnetic one-component toner. As the component, a kneading material obtained by 80 parts by weight of magnetic material particles, 2 parts of negative charge control agent of monoazo iron complex and 3 parts of low molecular weight polypropylene being melted and kneaded with 100 parts by weight of styrene n-butyl arylate copolymer as binding resin by a twin screw extruder heated to 140° C., and cooled, is roughly crushed by a hammer mill, and the roughly crushed material is finely crushed by a jet mill, and the thus obtained finely crushed material is air-classified to thereby obtain classified powder having a weight average diameter of 8.0 μm. 1.0 parts by weight of hydrophobic silica fine powder material is mixed with the classified material having the average particle diameter of 8.0 μm by Henschel Mixer to thereby obtain a developer. In the developing apparatus of the above-described construction, the coat amount of the toner on the developing sleeve regulated by the developing blade is of the order of 0.5-2.5 mg/cm$^2$.

As the developing bias voltage applied to the developing sleeve 105, when for example, the gap between the photosensitive drum and the developing sleeve is of the order of 300 mm, a DC voltage: −460V, an AC voltage: rectangular wave Vpp=1600V, and a frequency 2000 Hz are applied. Thereby, reversal developing of causing the toner to adhere to Vl portion which is the exposed portion of the photosensitive member is effected.

A detailed description will now be provided of electrically conductive particles 1 (second electrically conductive particles) as a lubricant which is a feature of the present invention. The electrically conductive particles 1 (second electrically conductive particles) are provided in the portion of contact between the developing sleeve and the developing blade in a state in which the developer does not exist between the developing sleeve and the developing blade.

As the electrically conductive particles 1 applied to the developing blade or the developing sleeve, mention may be made of tin oxide powder doped with antimony or fluorine or the like, zinc oxide powder doped with aluminum or the like, titanium oxide powder covered with tin oxide, or the like, but in the present embodiment, use is made of electrically conductive tin dioxide particles. Also, the volume resistivity value of the particle may preferably be $10^2$ Ω·cm or greater and $10^6$ Ω·cm or less. If the volume resistance value is less than $10^2$ Ω·cm, when a bias is applied to the developing sleeve in a case where the electrically conductive particles continue to adhere to the surface of the developing sleeve, the electrically conductive particles may leak onto the photosensitive drum, and this is not preferable. If the volume resistivity value exceeds $10^6$ Ω·cm, the particles become nearly insulative, and when they adhere to the charging roller, faulty charging becomes liable to occur. Also, when they adhere to the photosensitive member, it is liable to become the cause of a faulty image.

In the present embodiment, particles of the order of $10^4$ Ω·cm are used as the electrically conductive particles 1. Also, the average particle diameter thereof may preferably be of the order of 0.2-20 μm in terms of a particle diameter of D50 of a particle size distribution (which herein means the particle diameter of a fine particle in a portion wherein the amount of fine powder becomes 50% when accumulated in the order of a smaller particle diameter), and if the average particle diameter is less than 0.2 μm, van der Waals force will become strong and the particles will adhere to the surface of the developing sleeve or the developing blade and will not separate therefrom, and will affect the triboelectricity of the toner applied onto the developing sleeve, and thus the quality of image will be aggravated. Also, if the average particle diameter exceeds 20 μm, conversely it will become difficult for the particles to adhere to the surface of the developing sleeve or the developing blade and it will become difficult to apply the toner stably. In the present embodiment, use is made of particles of which D50 is 1.8 μm.

The measurement of the resistance of the electrically conductive particles herein was done by measuring and normalizing it by the tablet method. That is, a powder sample of about 0.5 g was put into a cylinder having a bottom surface area of 2.26 $cm^2$ and pressurization of 15 kg was effected on upper and lower electrodes and at the same time, a voltage of 100V was applied, and the resistance value was measured, and thereafter was normalized to thereby calculate specific resistance.

Figure 3:
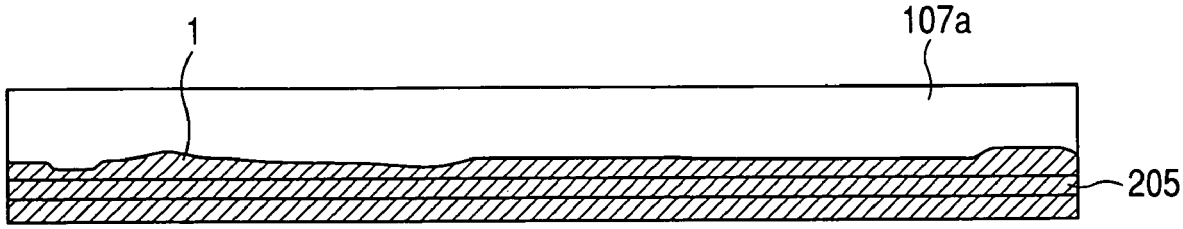
FIG. 3 is an illustration of a lubricant applying portion on a toner layer thickness regulating member in the first embodiment of the present invention.

Regarding a method of applying the electrically conductive particles 1 which are the lubricant in the present embodiment, as shown in FIG. 3, the electrically conductive particles 1 were dredged over a brush and then were applied to the vicinity of a nip surface 205 corresponding to that portion of the developing blade 107*a* which abuts against the developing sleeve 105, by the brush. The applying method is not restricted thereto, but may be a method of causing the electrically conductive particles to be contained in advance in a sponge roller or the like at the assembling step, and bringing the developing sleeve into contact with this sponge roller and rotating it to thereby apply the electrically conductive particles, or dispersing the lubricant in volatile liquid, directly applying this to the developing sleeve, and completely volatilizing the liquid. The lubricant is thus applied, whereby it comes to exist in and near the portion of contact between the developing blade and the developing sleeve. That is, in a state in which the toner seal 50 is not removed, in other words, in a state in which the developer does not exist between the developing sleeve and the developing blade, the electrically conductive particle is provided in the portion of contact between the developing sleeve and the developing blade.

When the developing blade 107*a* was made to abut against the developing sleeve 105 and the developing sleeve 105 was rotated after the electrically conductive particles 1 were applied to the developing blade 107*a* as described above, particularly rotational torque did not become abnormally great and the developing sleeve could be stably rotated. Also, thereafter, image forming was effected with the toner coated onto the developing sleeve, but an abnormal image attributable to frictional contact flaws on a halftone image or a solid black image did not occur. Also, when an image output was effected after the electrically conductive particles 1 used in the present embodiment were caused to adhere onto the charging roller, a black spot image did not occur and a uniform image could be stably obtained. Also, at the beginning of the use of the developing apparatus, neither toner charge-up nor a faulty image occurred. When without the electrically conductive particles 1 being provided between the developing blade and the developing sleeve, the electrically conductive particles 1 were extraneously added into the developer, the toner charge-up at the beginning of the use of the developing apparatus occurred.

Also, while in the present embodiment, a description has been provided of an example in a system wherein a voltage provided with an AC bias is applied to the charging roller, a similar effect could also be obtained in a system wherein a voltage of a DC bias alone was applied to the charging roller.

If as described above, electrically conductive particles are used as the lubricant applied onto the developing blade or the surface of the developing sleeve, and the design is made such that in a state in which the developer does not exist in the portion of contact between the developing blade and the developing sleeve, the electrically conductive particles exist in at least the portion of contact, the developing sleeve can be smoothly rotated even in a state in which the toner is not applied onto the developing sleeve, and an abnormal image attributable to the frictional contact flaws can also be prevented. Also, even if the electrically conductive particles adhere to the charging roller, a uniform image can be obtained without charging being spoiled. Further, the toner charge-up at the beginning of the use of the developing apparatus can also be prevented.

Second Embodiment

A feature of this embodiment is that the photosensitive drum, which is an image bearing member, the charging roller, which is charging means (charging member) and the developing apparatus are provided together in an interchangeable integral type cartridge, which in turn is detachably provided in the main body of the image forming apparatus. The charging roller need not always be provided in the cartridge, and the charging roller and the photosensitive drum can be provided not in the cartridge, but in the main body of the image forming apparatus, or the charging roller and the photosensitive drum may be detachably mountable on the main body of the image forming apparatus as a cartridge discrete from the cartridge provided with the developing apparatus.

Figure 4:
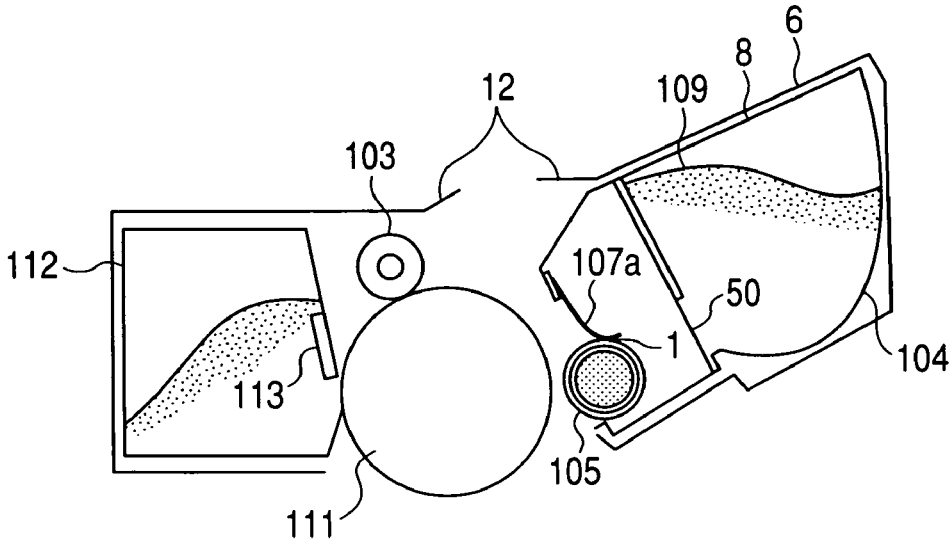
FIG. 4 is a schematic cross-sectional view of a process cartridge according to a second embodiment of the present invention.
Figure 5:
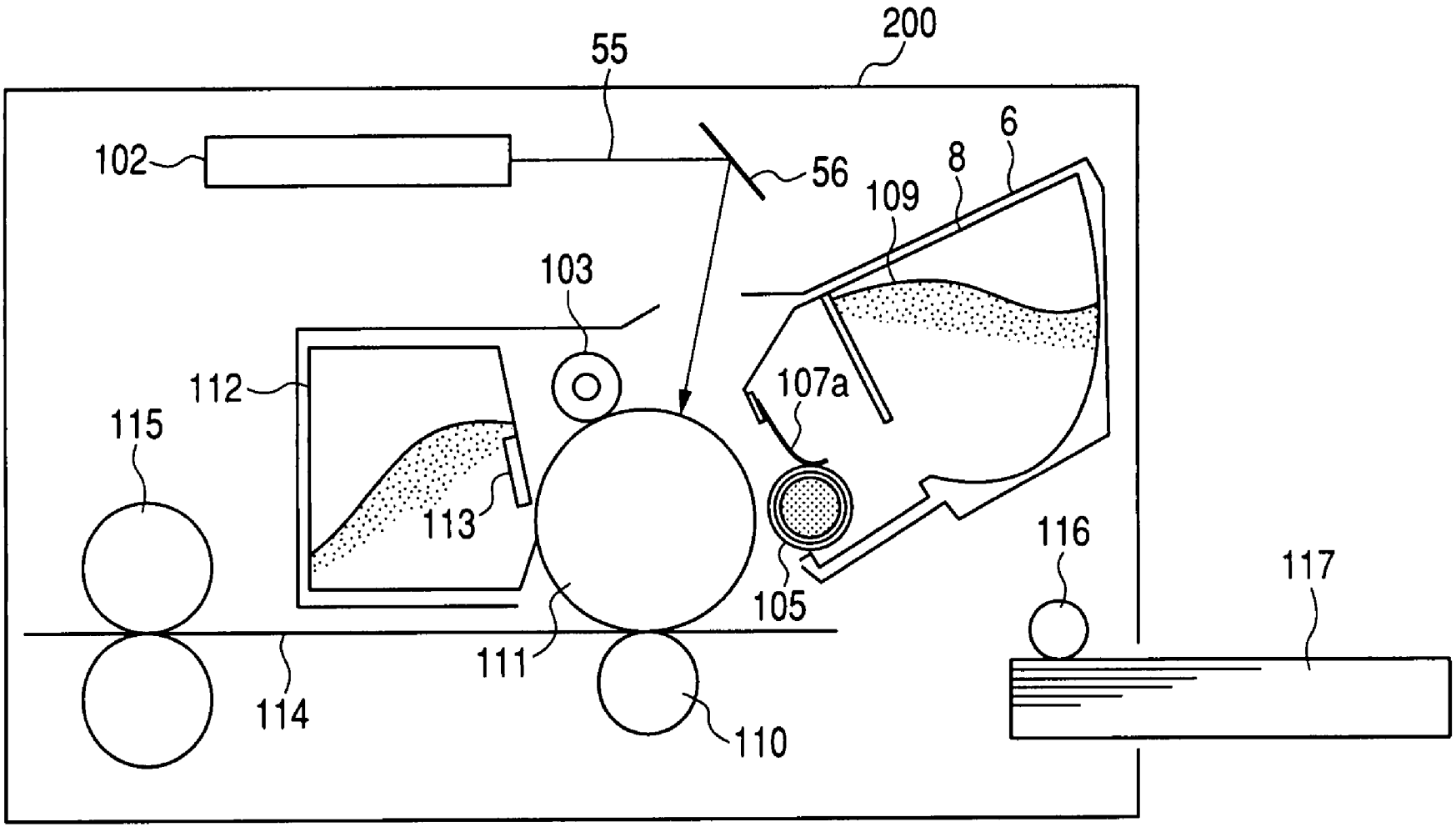
FIG. 5 is a schematic cross-sectional view of an image forming apparatus according to the second embodiment of the present invention.

FIG. 4 shows an example of the integral type cartridge, and FIG. 5 shows a state in which after the toner seal 50 has been removed in the integral type cartridge 6, the cartridge has been inserted into the main body of the image forming apparatus 200.

In both of these figures, members of the same construction that have previously been described in the first embodiment are given the same reference characters. In the present embodiment, the photosensitive drum 111, the charging roller 103 and the developing apparatus 8 using the electrically conductive particles (second electrically conductive particles) 1 as the lubricant are united together by packaging 12 to thereby make an integral type cartridge. In the case of this integral type cartridge 6, the design is made such that when the toner 109 has been used up, the other apparatuses also meet the end of their lives substantially at the same time. Accordingly, the user can always obtain stable images as long as the toner exists in the cartridge, and moreover, there is the advantage that because of being of the integral type, the exchange of the cartridge can also be effected easily.

By the electrically conductive particles 1 being used as the lubricant, the developing sleeve can be smoothly rotated even in a state in which the toner is not applied onto the developing sleeve, and an abnormal image attributable to frictional contact flaws can also be prevented, and there is added the advantage that even if the electrically conductive particle adheres to the charging roller 103, a uniform image can be obtained without faulty charging being caused.

Third Embodiment

A feature of this embodiment shows, for example, the case of an image forming apparatus of such a cleanerless system as proposed in Japanese Patent Application Laid-open No. H10-307455.

Figure 6:
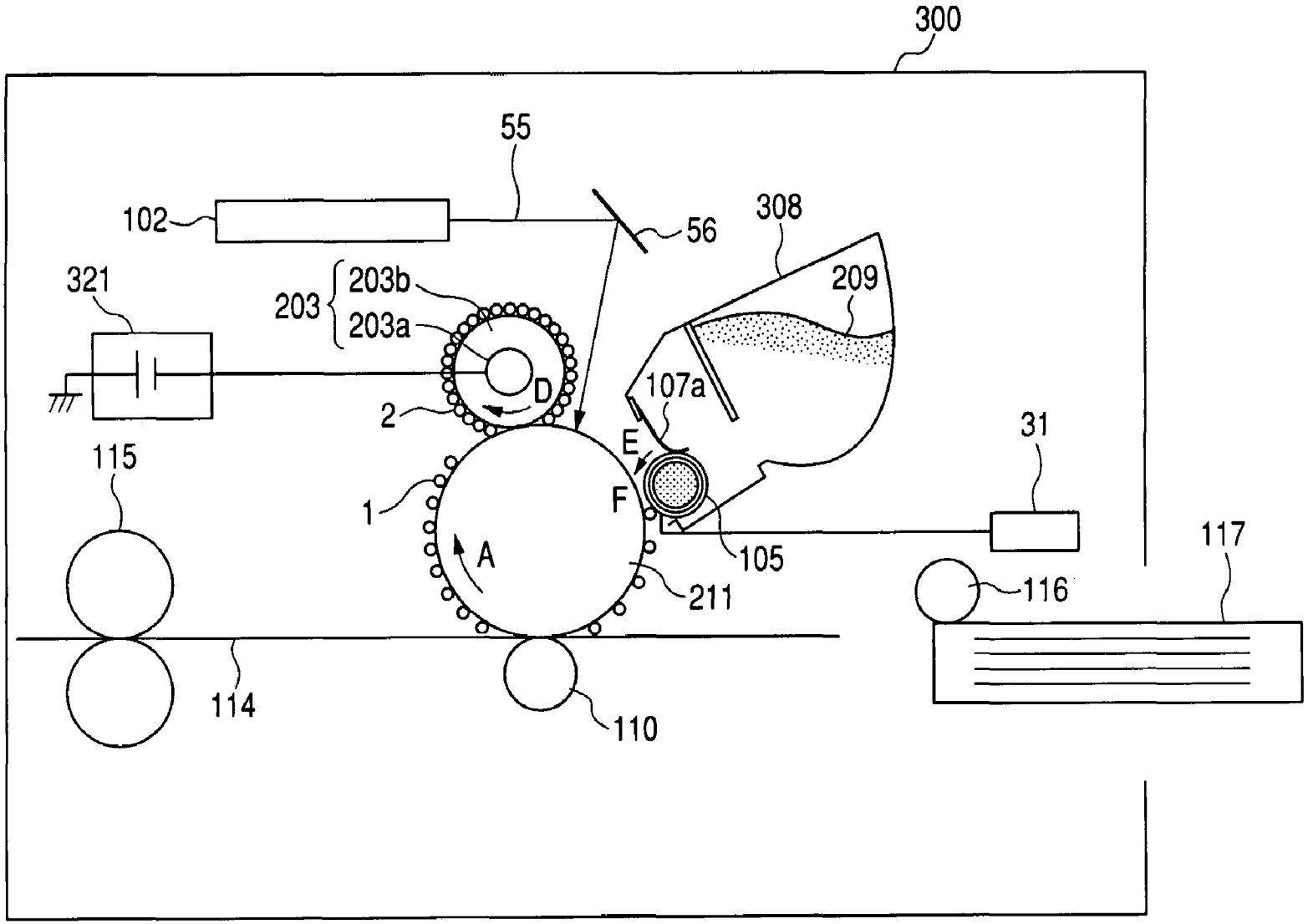
FIG. 6 is a schematic cross-sectional view of an image forming apparatus according to a third embodiment of the present invention.

FIG. 6 shows the feature of an image forming apparatus according to a third embodiment of the present invention best. In FIG. 6, the same constituents as those described in the example of the conventional art are given the same reference characters.

The main body 300 of the image forming apparatus in FIG. 6 uses a direct injection charging process. The direct injection charging process is a process in which charges are directly injected from a contact charging member into a member to be charged (here, the photosensitive drum) through a portion of contact, whereby the surface of the member to be charged is charged. It is also called direct charging, or injection charging, or charge injection charging. More particularly, it effects charge injection directly into the surface of the member to be charged by a contact charging member of medium resistance contacting with the surface of the member to be charged, without the intermediary of a discharging phenomenon, i.e., without basically using discharge. In the present embodiment, electrically conductive particles 2 (third electrically conductive particles) are applied in advance onto the charging member in its unused state. Accordingly, as will be described later, the electrically conductive particles exist in the portion of contact between the charging member and the member to be charged, whereby the charge injecting property from the charging member to the member to be charged is improved.

In the injection charging process, the relation between the applied voltage to the charging member and the surface potential of the member to be charged is such that the two are substantially proportional to each other. Consequently, even if the applied voltage to the contact charging member is an applied voltage equal to or less than a discharge threshold value, the member to be charged can be charged to a potential corresponding to the applied voltage.

If a direct injection charging mechanism is used as described above, the production of ions by discharge does not accompany this process, and this leads to the great advantage that the evil by a discharge product (for example, the problem of "image deletion" that the forming of a latent image is hindered by the produced discharge product and a substance in the transfer material acting on each other) does not arise.

Also, a description will hereinafter be provided of a process in which the image forming apparatus 300 achieves the cleanerless system.

The toner as the developer and the electrically conductive particles (first electrically conductive particles) are contained in the developing apparatus, and a suitable amount of electrically conductive particles shifts to the photosensitive drum side together with the toner during the toner-developing of the electrostatic latent image on the photosensitive drum by the developer carrying member.

The toner image on the photosensitive drum is attracted and positively shifts to the recording medium which is an image receiving member in the transferring means portion under the influence of a transferring bias, but the electrically conductive particles on the photosensitive drum are electrically conductive and therefore do not positively shift to the recording medium side and substantially adhere to and are held on the photosensitive drum and are residual thereon. Also, if the design is made such that the toner is frictionally charged to a negative polarity, whereas these electrically conductive particles are provided with the characteristic of being frictionally charged to a positive polarity, it will more rarely happen that such particles shift to the recording medium, and this is preferable.

Then, the untransferred toner residual on the surface of the photosensitive drum after the transfer and the above-described residual electrically conductive particles (first electrically conductive particles) are intactly carried to the portion of contact between the photosensitive drum and the contact charging member by the movement of the surface of the photosensitive drum and adhere to and get mixed with the contact charging member.

Accordingly, the first electrically conductive particles are supplied to third electrically conductive particles existing in advance in the portion of contact between the photosensitive drum and the contact charging member, and in a state in which the electrically conductive particles are deficient, the direct injection charging on the photosensitive drum is effected.

By the presence of these electrically conductive particles, the close contacting property and contact resistance of the contact charging member with respect to the photosensitive drum can be maintained even when the toner adheres to and gets mixed with the contact charging member and therefore, in spite of the contact charging member being a simple member such as a charging roller or a fur brush and moreover, in spite of the contamination of the contact charging member by the untransferred toner, the direct injection charging of the photosensitive drum by the contact charging member can be effected.

That is, the contact charging member closely contacts the photosensitive drum with the electrically conductive particles interposed therebetween, and the electrically conductive particles existing in the portion of contact between the contact charging member and the photosensitive drum rub against the surface of the photosensitive drum without any gap therebetween, whereby regarding the charging of the photosensitive drum by the contact charging member, stable and safe direct injection charging which does not use the discharging phenomenon becomes dominant owing to the presence of the electrically conductive particles, and there can be obtained high charging efficiency which could not be obtained by the conventional roller charging or the like, and a potential substantially equal to the voltage applied to the contact charging member can be given to the image bearing member.

Also, the untransferred toner which has adhered to and become mixed with the contact charging member is gradually discharged from the contact charging member onto the photosensitive drum and comes to the developing portion with the movement of the photosensitive drum, and is cleaned (collected) simultaneously with developing in the developing means (toner recycle process). Prior to being cleaned simultaneously with developing, the photosensitive drum on which the untransferred toner is present is charged by the charging member and is exposed by the exposing means, whereby an electrostatic latent image is formed thereon.

Also, as previously described, even if the initial electrically conductive particles 2 (third electrically conductive particles) come off from the contact charging member, the image forming apparatus is operated, whereby the electrically conductive particles (first electrically conductive particles) contained in the developer of the developing means shift to the surface of the photosensitive drum in the developing portion and are carried to the charging portion via the transferring portion by the movement of the surface of the photosensitive drum and continue to be sequentially supplied to the contact charging member and therefore, a good charging property by the presence of the electrically conductive particles is stably maintained.

Thus, in the image forming apparatus of the contact charging type, the transfer type and the toner recycle process type, ozoneless direct injection charging at a low applied voltage can be maintained stable for a long period of time by the use of a simple member such as a charging roller or a fur brush as the contact charging member and moreover, in spite of the contamination of the contact charging member by the untransferred toner.

The image forming process in the present embodiment will hereinafter be described in greater detail.

Figure 7:
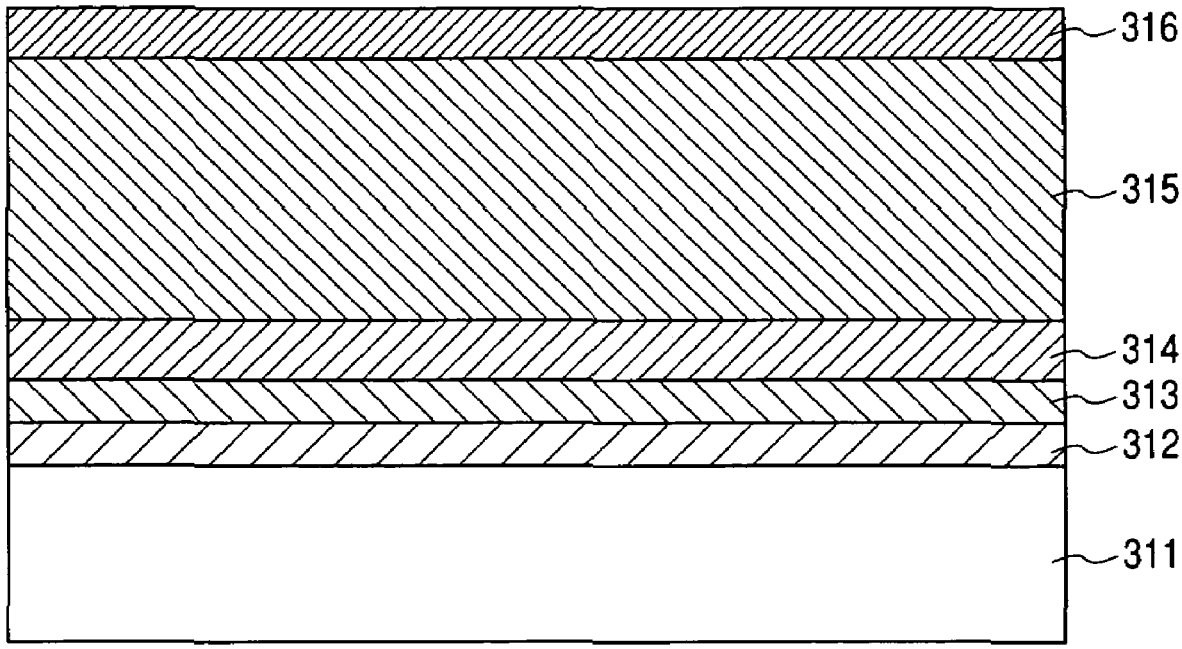
FIG. 7 shows the construction of a photosensitive drum in the third embodiment of the present invention.

The photosensitive drum 211 has the resistance of its surface adjusted by a charge injection layer being provided on the surface of the photosensitive drum 211. FIG. 7 is a layer construction model view of the photosensitive drum 211 provided with a charge injection layer on its surface which is used in the present embodiment.

That is, the photosensitive drum 211 is improved in charging performance in a direct injection charging mechanism by applying a charge injection layer 316 to a popular organic photosensitive drum comprising an aluminum drum base (Al drum base) 311 coated with an undercoat layer 312, a positive charge blocking layer 313, a charge generation layer 314 and a charge transport layer 315 in the named order. The charge injection layer 316 is provided by mixing and dispersing a lubricant such as SnO2 super-fine particles (having a diameter of about 0.03 mm) or tetrafluoroethylene resin (trade name Teflon (registered trademark)) as an electrically conducting filler, a polymerization starting agent, etc. in photo-curing type acryl resin as a binder, and applying them as coating, and thereafter forming film by a photo-curing method.

An important point about the charge injection layer 316 resides in the volume resistivity of the surface layer. In the charging process by the direct injection of charges, the giving and receiving of the charges become capable of being efficiently effected by reducing the volume resistivity of the member to be charged. On the other hand, when it is used as a photosensitive member, it is necessary to hold an electrostatic latent image thereon for a predetermined time and therefore, as the volume resistivity value of the charge injection layer 316, a range of 1 109-1 1014 (W·cm) is suitable.

Also, even in a case where as in the present construction, the charge injection layer 316 is not used, an equal effect is obtained if, for example, the charge transport layer 315 is within the above-mentioned resistivity range.

Further, an amorphous silicon photosensitive member or the like whose surface layer has a volume resistivity of about $10^{13}$ Ω·cm may be used to obtain a similar effect.

The same electrically conductive particles 2 as the electrically conductive particles 1 used as the lubricant in the first embodiment are applied to the charging roller 203 at the initial stage before the user uses it. In the present embodiment, as the specific resistance required of the electrically conductive particles applied to the charging roller, $10^9$ Ω·cm or less is good, and preferably $10^6$ Ω·cm or less is desirable. As the electrically conductive particles 2 to be applied at the initial stage of the use of the charging roller 203, like that described in the first embodiment, mention may be made of tin oxide powder doped with antimony or fluorine or the like, zinc oxide powder doped with aluminum or the like, titanium oxide powder covered with tin oxide, electrically conductive tin dioxide or the like, but in the present embodiment, use is made of titanium oxide powder covered with tin oxide.

Also, the volume resistivity of the electrically conductive particles 2 is $10^3$ Ω·cm. Consequently, even at the beginning of the use, the electrically conductive particles 2 intervene between the photosensitive drum 211 and the charging roller 203 and therefore, the charging roller 203 to which a voltage (DC voltage of −620V) has been applied from a voltage source 321 is brought into contact with the photosensitive drum 211, whereby the surface of the photosensitive drum 211 can be uniformly charged to dark potential (Vd) of about −600V. Unless the electrically conductive particle 2 is provided, faulty charging is liable to occur at the beginning of the use, and the faulty charging gives rise to the problem that the toner adheres to the background portion of an image.

Also, as described above, the electrically conductive particles in the developer are carried from the developing means to the charging roller through the intermediary of the photosensitive drum, and the charging roller gains these electrically conductive particles to thereby maintain the charging process for a long period. Accordingly, when the image forming process is started, the electrically conductive particles (third electrically conductive particles) applied at the beginning of the use of the charging roller mix with the electrically conductive particles (first electrically conductive particles) carried from the developing means and exist on the charging roller to thereby carry out the charging process. Consequently, it is preferable that the first electrically conductive particles and the third electrically conductive particles be entirely the same.

Figure 9:
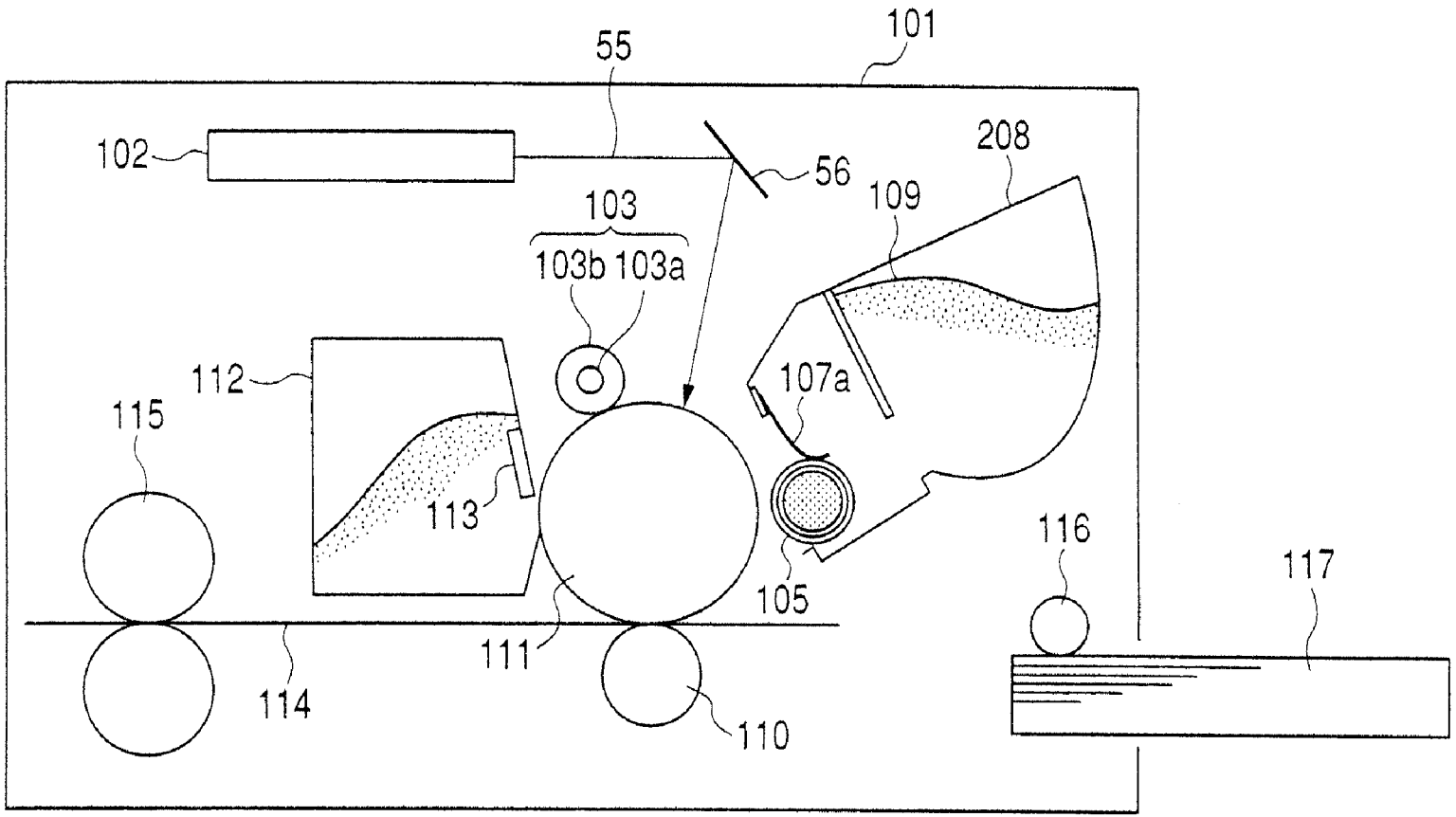
FIG. 9 is a schematic cross-sectional view of an image forming apparatus according to the conventional art.
Figure 10:
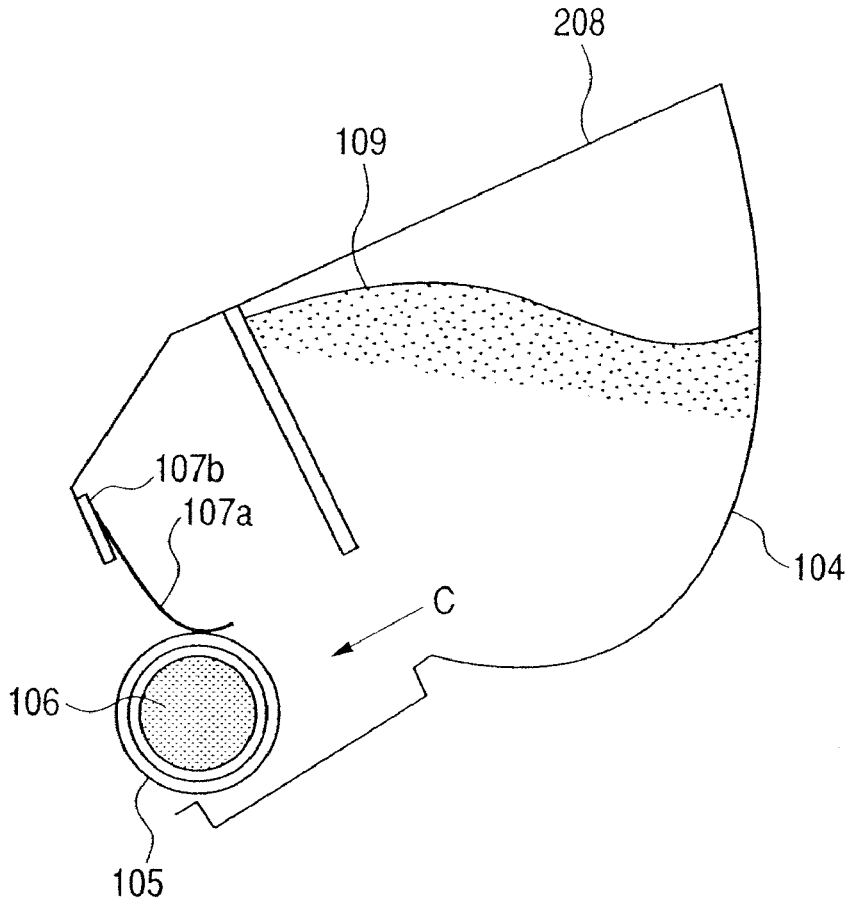
FIG. 10 is a schematic cross-sectional view of a developing apparatus according to the conventional art.
Figure 11:
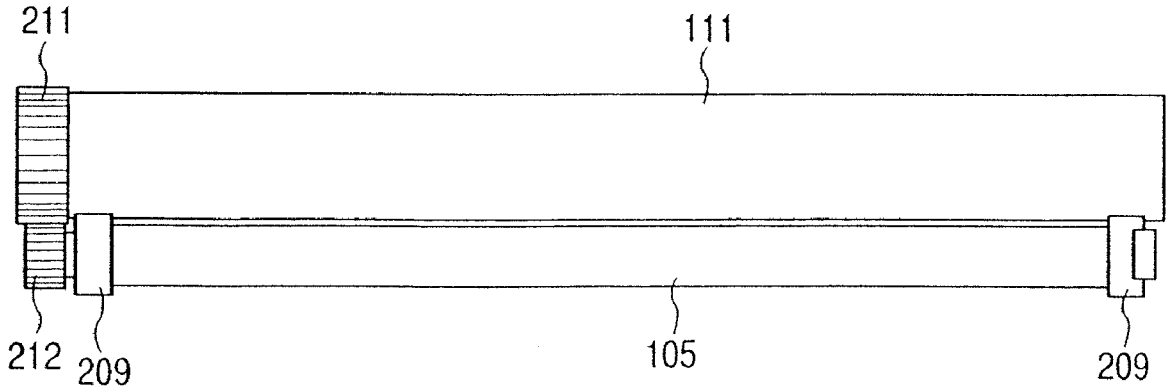
FIG. 11 is an illustration of the constructions of a photosensitive drum and a developing sleeve according to the conventional art.

In the example of the conventional art as shown in FIG. 9, a voltage comprising a DC voltage and an AC voltage superimposed one upon the other was usually applied to the charging roller to thereby stably charge the surface of the photosensitive drum, and prevented an image defect such as a sandy ground (the phenomenon of the toner flying to a white image) due to faulty charging. However, as already described, the production of a discharge product cannot be avoided in principle by such a discharge charging mechanism. In contrast, in the present embodiment, only a DC voltage is applied to the charging roller and therefore, without any discharge product being produced, the surface of the photosensitive drum can be charged.

The charging roller 203 will be described here in greater detail. The charging roller 203 is made by forming on a mandrel 203*a* a medium-resistance layer 203*b* of rubber or a foamed material which is a flexible member. The medium-resistance layer 203*b* is prescribed by resin (e.g. urethane), an electrically conducting filler (e.g. carbon black), a sulfidizing agent, a foaming agent or the like, and was formed into a roller shape on the mandrel 203*a*. Thereafter, it was made with its surface polished as required.

Also, the charging roller 203 is rotated at a speed of 150% in terms of peripheral speed difference in the portion of contact between the roller 203 and the drum 211 in a direction of rotation indicated by the arrow D, which is a counter direction relative to the direction of rotation indicated by the arrow A of the photosensitive drum 211, to thereby strip off many of the electrically conductive particles existing on the photosensitive drum 211. Thereby, the electrically conductive particles supplied from the developing sleeve 105 can be applied onto the charging roller 203, and the electrically conductive particles intervene between the charging roller 203 and the photosensitive drum 211, whereby direct injection charging is realized.

A laser beam 55 emitted from the exposing means 102 is applied onto the photosensitive drum 211 charged as previously described, via a mirror 56, to thereby form an electrostatic latent image on the photosensitive drum 211. At this time, the surface potential of the photosensitive drum 211 when the laser beam 55 has been uniformly applied onto the photosensitive drum 211 is set to light potential (VL=−150V).

A developing apparatus 308 is disposed in opposed relationship with the photosensitive drum 211. The developing apparatus 308 is constituted by a developing sleeve 105 disposed with a predetermined gap amount kept relative to the photosensitive drum 211, a developing blade 107*a*, a magnet roll 106 contained in the developing sleeve 105, and a voltage source 31 for supplying a voltage to the mandrel of the developing sleeve 105.

The developing sleeve 105 receives a drive force from the photosensitive drum and is rotated in the direction indicated by the arrow E in FIG. 6, and carries a toner 209 including electrically conductive particles (first electrically conductive particles) in a toner container 104 to the photosensitive drum. In the present embodiment, a voltage comprising a predetermined AC voltage and a DC voltage of −400V superimposed one upon the other is applied from the voltage source 31 to the developing sleeve 105 of the developing means adopting such a construction, whereby the electrostatic latent image on the photosensitive drum 211 is visualized by the toner carried by the developing sleeve.

Thereafter, the toner image borne on the surface of the photosensitive drum 211 is sequentially transferred to paper conveyed in synchronism with the rotation of a transfer roller 110 provided in the main body 300 of the image forming apparatus, and the paper having received the transfer of the toner image is separated from the surface of the photosensitive drum 211 and is conveyed to fixing means 115 provided in the main body 300 of the image forming apparatus, and is subjected to the fixing of the toner image. Any untransferred toner residual on the surface of the photosensitive drum 211 after the transfer of the toner image to the transfer material 114 is not removed by a cleaner, but comes to a developing portion F via the position of the charging roller 203 with the rotation of the photosensitive drum 211, and is cleaned (collected) simultaneously with developing by the developing sleeve 105 (toner recycle process).

In the present embodiment, a toner base material was constituted by styrene resin, and 2 parts by weight of silica as an extraneous additive for promoting the charging of the toner, and as the electrically conductive particles (first electrically conductive particles) 2 parts by weight of electrically conductive tin dioxide, which is the same particle as that in the first embodiment, were extraneously added to 100 parts by weight of toner base material. The particle resistance required of the electrically conductive particle contained in the toner in the present embodiment should preferably be $10^9$ Ω·cm or less as specific resistance, and more preferably be $10^6$ Ω·cm or less. The electrically conductive particles 1 used as the lubricant in the first embodiment are also $10^6$ Ω·cm or less, and are usable in achieving the cleanerless system in the present embodiment.

Figure 8:
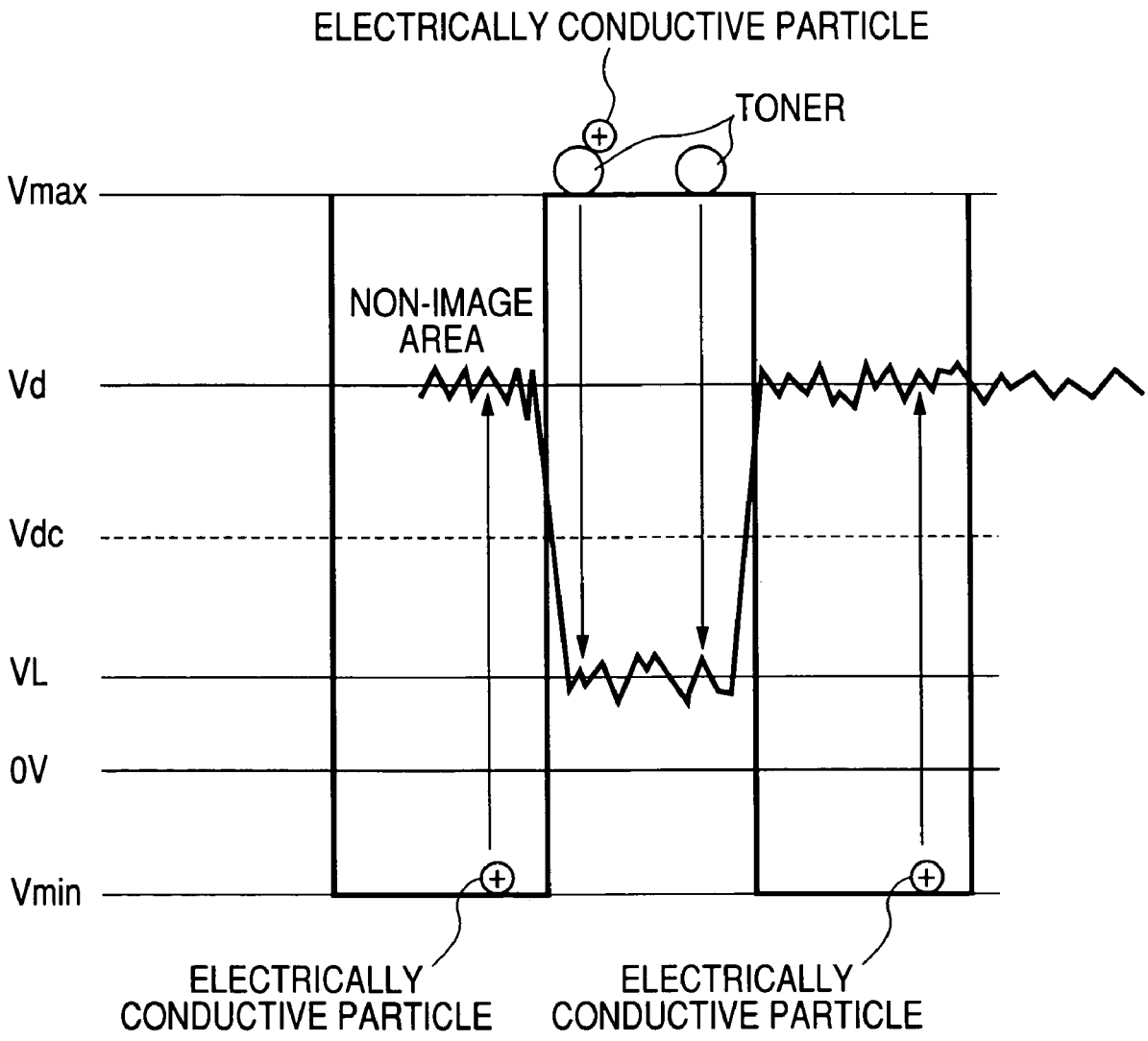
FIG. 8 is an illustration of the flight of electrically conductive particles in the relation between the potential of the photosensitive drum in the third embodiment of the present invention and a developing bias.

The electrically conductive particles (first electrically conductive particles) in the developer in the present embodiment are frictionally charged with the toner to thereby exhibit a positive tendency as a charging characteristic. Accordingly, when as shown in FIG. 8, for example, an AC voltage of 1.2 kV is applied to the developing sleeve 105, the electrically conductive particle as an extraneous additive to the toner singly flies from the developing sleeve 105 to the non-image area of the photosensitive drum 211 with a contrast of 800V (|Vmin−Vd|=|200−(−600)|). Also, some of the electrically conductive particles adhere to the toner, and fly from the developing sleeve 105 to the image area of the photosensitive drum 211 with a contrast of 850V (|VL−Vmax|=|−150−(−1000)|).

These electrically conductive particles having flown onto the drum are electrically conductive and therefore, are residual on the photosensitive drum 211 together with the untransferred toner after the transferring step. Thereafter, as previously described, many of the electrically conductive particles are stripped off by the charging roller 203 rotated in the counter direction relative to the photosensitive drum 211, whereby the electrically conductive particles can be made to adhere onto the charging roller 203. In this manner, the electrically conductive particles are supplied from the developing apparatus 308 to the charging roller 203 through the intermediary of the photosensitive drum 211 to thereby realize direct injection charging even if the electrically conductive particles applied to the charging roller 203 at the initial stage are decreased by the number of passed sheets being increased.

Here, as the lubricant used in the developing apparatus, as in the first embodiment, the electrically conductive particles 1 are applied to the developing blade 107*a* in a state in which the developer does not exist between the developing blade and the developing sleeve (the state before the use of the developing apparatus). It provides action similar to that in the first embodiment that the electrically conductive particles 1 are applied to the developing blade and the electrically conductive particles 1 exist in the portion of contact between the developing blade and the developing sleeve and therefore, even in a state in which the toner was not applied to the developing sleeve, the developing sleeve could be smoothly rotated, and even if thereafter the developing sleeve was coated with the toner to thereby effect an image output, an abnormal image attributable to frictional contact flaws did not occur.

Also, while an image output was effected with the electrically conductive particles 1 made to adhere onto the charging roller 203 to which the electrically conductive particles 2 were applied, faulty charging did not occur, but a uniform image could be obtained. That is, the volume resistivity of the electrically conductive particles 1 is within the condition of the particles applied to the charging roller which effects direct injection charging and therefore, the charging was not hindered by the electrically conductive particles in the developer. That is, the electrically conductive particles 1 applied as the lubricant onto the developing blade or the developing sleeve are within the volume resistivity of the particle required in the charging roller of the direct injection charging type and therefore, can also be applied onto the charging roller of the direct injection charging type without any problem.

Also, the condition of the particle resistivity of the electrically conductive particles contained in the toner in the present embodiment is within the condition of the particle resistivity of the electrically conductive particles 1 applied as the lubricant onto the developing blade or the developing sleeve and therefore, the electrically conductive particles 1 as the lubricant for the developing blade or the developing sleeve, the electrically conductive particles 2 applied onto the charging roller of the direct injection charging type as shown in the present embodiment, and the electrically conductive particles as the extraneous additive for the toner used in the cleanerless system also of the direct injection charging type may be the same. Thereby, a decrease in cost can also be achieved.

As described above, the electrically conductive particles existing in and near the nip portion between the developing blade and the developing sleeve function as a lubricant and yet, do not cause faulty charging because of being electrically conductive even if they adhere onto the charging roller, and a uniform image can be obtained.

Also, in a case where the image bearing member, the charging member and the developing apparatus are provided in the process cartridge, in addition to image stability and easy maintenance property which are the features of the process cartridge, even if the lubricant adheres to the charging roller by the developing apparatus of the above-described embodiment being used, faulty charging does not occur because the lubricant is electrically conductive, and a uniform image can be obtained.

Also, if the design is made such that as the lubricant, the electrically conductive particles 1, the electrically conductive particles included in the developer, and the electrically conductive particles 2 applied to the unused charging roller are materials of the same kind, the electrically conductive particles existing in and near the nip portion between the developing blade and the developing sleeve function as the lubricant and yet can achieve a decrease in cost, and even if they adhere onto the charging roller, they do not cause faulty charging because of their being electrically conductive, and a uniform image can be obtained.

As described above, according to the present invention, the electrically conductive particles are provided between the developer carrying member and the developer layer thickness regulating member, whereby even in a state in which there is no developer between the developer carrying member and the developer layer thickness regulating member, the developer carrying member can be smoothly moved, and an abnormal image attributable to frictional contact flaws can also be prevented, and even if the electrically conductive particles adhere to the charging means, faulty charging is not caused and a uniform image can be obtained.

Also, it is possible to make the electrically conductive particles used while being contained in the developer and the electrically conductive particles provided between the developer layer thickness regulating member and the developer carrying member the same, and further, in a case where the charging means is provided with a charging member contacting with the image bearing member, it is also possible to make the electrically conductive particles applied to the charging member the same, and the occurrence of such faulty charging as when the particles are insulative particles can be suppressed and yet, a decrease in cost can also be achieved.

Also, the electrically conductive particles are provided between the developer carrying member and the developer layer thickness regulating member, whereby at the beginning of the use of the developing apparatus, the initial charge-up of the developer can be prevented.

This application claims priority from Japanese Patent Application No. 2003-413500 filed on Dec. 11, 2003, which is hereby incorporated by reference herein.

What is claimed is:

1. A developing apparatus comprising:

a developer carrying member configured and positioned to carry a developer thereon and to develop an electrostatic image formed on an image bearing member with the developer;

a developer layer thickness regulating member provided in contact with said developer carrying member and configured and positioned to regulate the thickness of a layer of the developer carried on said developer carrying member; and an electrically conductive particle interposed in a nip portion between a surface of said developer carrying member and a surface of said developer layer thickness regulating member so that said electrically conductive particle is able to slip off from the surface of said developer carrying member and the surface of said developer layer thickness regulating member, in a state in which the developer does not exist between said developer carrying member and said developer layer thickness regulating member.

2. A developing apparatus according to claim 1, wherein in the state in which the developer does not exist between said developer carrying member and said developer layer thickness regulating member, said electrically conductive particle is further provided on said developer carrying member or said developer layer thickness regulating member near said portion of contact.

3. A developing apparatus according to claim 1 or 2, wherein the volume resistivity of said electrically conductive particle is $10^2$ Ω·cm or greater and $10^6$ Ω·cm or less.

4. A cartridge detachably mountable on a main body of an image forming apparatus, said cartridge comprising:

a developer carrying member configured and positioned to carry a developer thereon and to develop an electrostatic image formed on an image bearing member with the developer;

a developer layer thickness regulating member provided in contact with said developer carrying member and configured and positioned to regulate the thickness of a layer of the developer carried on said developer carrying member; and an electrically conductive particle interposed in a nip portion between a surface of said developer carrying member and a surface of said developer layer thickness regulating member so that said electrically conductive particle is able to slip off from the surface of said developer carrying member and the surface of said developer layer thickness regulating member, in a state in which the developer does not exist between said developer carrying member and said developer layer thickness regulating member.

5. A cartridge according to claim 4, further comprising said image bearing member.

6. A cartridge according to claim 5, further comprising a charging member contacting said image bearing member to charge said image bearing member.

7. A cartridge according to claim 4, wherein in the state in which the developer does not exist between said developer carrying member and said developer layer thickness regulating member, said electrically conductive particle is further provided on said developer carrying member or said developer layer thickness regulating member near said portion of contact.

8. A cartridge according to any one of claims 4 to 7, wherein the volume resistivity of said electrically conductive particle is $10^2$ Ω·cm or greater and $10^6$ Ω·cm or less.

* * * * *